United States Patent [19]

Habiger et al.

[11] 4,028,890

[45] June 14, 1977

[54] PISTON PUMP ASSEMBLY UTILIZING LOAD PRESSURE CONTROL

[75] Inventors: Cyril W. Habiger; Donald L. Hopkins, both of Joliet, Ill.

[73] Assignee: Caterpillar Tractor Co., Peoria, Ill.

[22] Filed: Jan. 23, 1976

[21] Appl. No.: 651,887

[52] U.S. Cl. ..... 60/443; 60/444; 60/445; 60/451; 417/218

[51] Int. Cl.[2] ..... F04B 1/26

[58] Field of Search ..... 60/444, 445, 451, 452, 60/443; 417/213, 218, 222; 137/625.3, 625.37

[56] References Cited

UNITED STATES PATENTS

| | | | |
|---|---|---|---|
| 3,742,982 | 7/1973 | Miller | 60/452 |
| 3,804,123 | 4/1974 | Marshall | 137/625.3 |
| 3,809,501 | 5/1974 | Weisenbach | 417/222 |
| 3,861,145 | 1/1975 | Hall et al. | 60/445 |

FOREIGN PATENTS OR APPLICATIONS

| | | | |
|---|---|---|---|
| 47-3927 | 4/1972 | Japan | 417/222 |

*Primary Examiner*—Carlton R. Croyle
*Assistant Examiner*—Gregory P. LaPointe
*Attorney, Agent, or Firm*—Frank L. Hart

[57] ABSTRACT

A piston pump having a housing and an angularly adjustable swash plate for controlling piston displacement and the flow of fluid discharged from the pump has control means for controllably positioning the swash plate in response to a load pressure.

6 Claims, 3 Drawing Figures

PISTON PUMP ASSEMBLY UTILIZING LOAD PRESSURE CONTROL

BACKGROUND OF THE INVENTION

The present invention relates to variable displacement asial piston pumps and pertains particularly to a variable displacement axial piston pump having displacement control means which are automatically operative to maintain and infinitely vary displacement of said pump.

Variable displacement pumps are often utilized in earth moving and other heavy duty machinery because pump flow and system pressure can be varied to meet system demands. Such variable displacement pumps are often equipped with pressure compensator controls for controlling or varying pump output pressure in response to system pressure.

A number of control systems are known which rely on load pressure of the system for controlling the displacement of the pump. However, these prior art systems also fail to include sufficient variables to insure precise and continuous control of the displacement.

The prior art is exemplified by the following patents: U.S. Pat. No. 2,892,312 which issued to J. R. Allen et al from an application filed on Jan. 27, 1958, and which is assigned to Deere & Company; U.S. Pat. No. 3,738,111 which issued to E. H. Fletcher from an application filed on Nov. 11, 1971, which is assigned to Deere & Company; and U.S. Pat. No. 3,444,689 which issued to T. Budzich on May 20, 1969 from an application filed on Feb. 2, 1967, and which is assigned to The Weatherhead Company.

Accordingly, this invention resides in a pump assembly having control means for varying the displacement of the pump in response to load pressure on the pump.

DETAILED DESCRIPTION OF THE INVENTION

Figure 1:
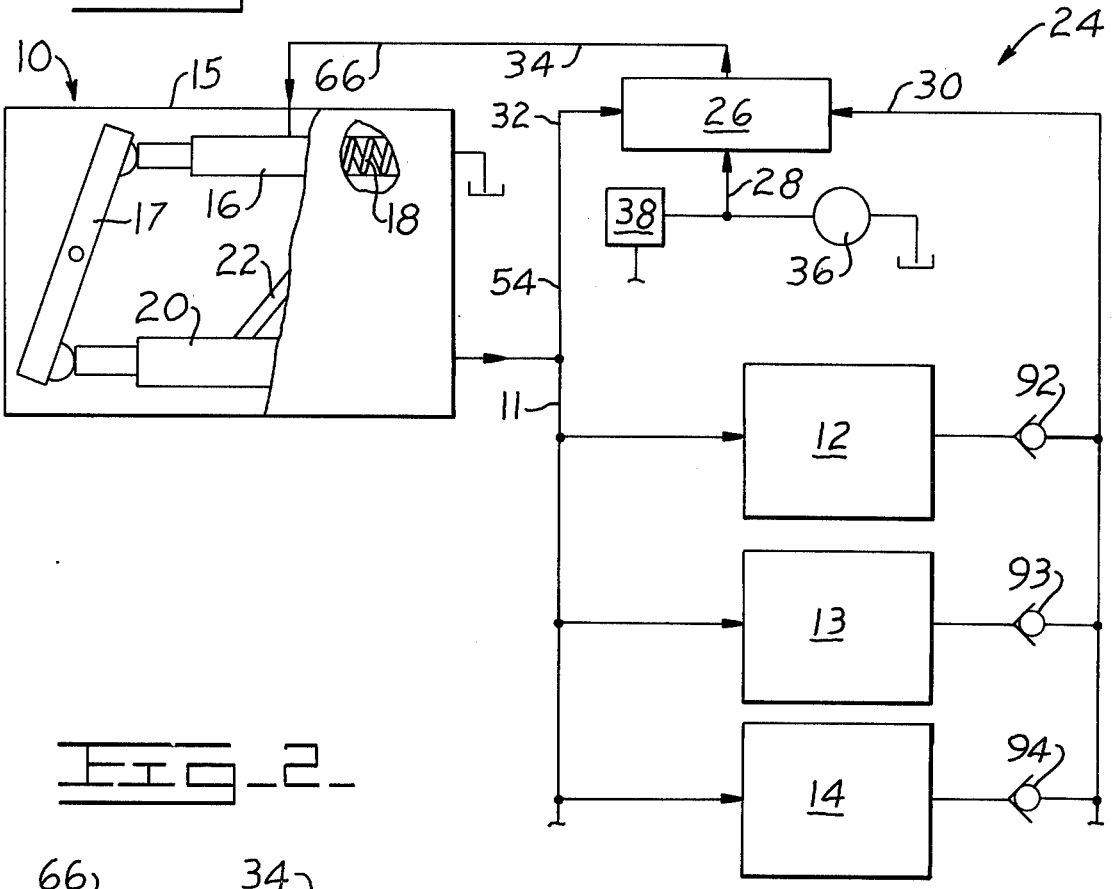
FIG. 1 is a diagrammatic view of a portion of a piston pump assembly and associated hydraulic system.

Referring to FIG. 1, an example variable displacement axial piston pump 10 is connected via line 11 to hydraulic motor assemblies 12,13,14 for the operation thereof. Line 11 can be connected to other work elements for the operation thereof without departing from this invention.

The piston pump assembly 10 has a housing, and an angularly adjustable swash plate 17 for controlling the volume of fluid discharged from the pump 10. A servo valve 16 has a biasing means 18 and is positioned in contact with the swash plate 17 at a location sufficient for biasing the swash plate 17 toward one of a maximum or minimum fluid discharge position and means 20 positioned in contact with the swash plate 17 at a location sufficient for biasing the swash plate 17 toward the other fluid discharge position. Means 20 is in communication with fluid discharging from the pump 10 via line 22 for biasing the swash plate 17 in response to the pressure of the discharging fluid.

The construction of the above-mentioned piston pump 10, swash plate 17, servo valve 16, and biasing means 20 is well known in the art. As is further known in the art, the swash plate 17 is maintained at a desirable position by elements 16,20 in response to the pressure of fluid discharging from the pump 10 and the force of the biasing means 18.

Figure 3:
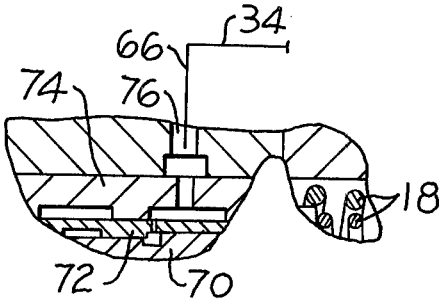
FIG. 3 is a diagrammatic partial sectional view of the servo valve of FIG. 1.

Referring to FIG. 3, and as more fully described in the above-mentioned U.S. Pat. No. 3,830,594, pistons and valving means of the servo valve 16 and means 20 act relative to one another on the discharge pressure of the pump 10 to controllably position the swash plate 17. The servo valve 16 has a spool 70 slidably positioned within a sleeve 72 which is in turn slidably positioned within the servo valve housing 74. In this invention, port 76 of the housing 74 is connected in fluid communication with conduit 34 for passage of a hereafter more fully described pressure signal 66 to the servo valve 16. The pressure signal 66 passes through the sleeve 72 and acts on the effective area of spool 70 for biasing the spool 70 and thereby controlling the position of the associated swash plate 17.

Control means 24 is associated with the piston pump assembly for imparting a biasing force on the servo valve 16 for biasing the swash plate 17 in response to a preselected pilot pressure modified in response to a load pressure.

The term "load pressure" as used herein is well known in the art of hydraulics and is that pressure in an implement's load carrying device required to maintain or move the load with respect to the ground in either static or dynamic conditions.

The control means 24 has a signal control means 26 for modifying a control fluid stream 28 in response to the load pressure of a hydraulic load stream 30 and the pressure of a fluid stream 32 discharging from the pump and delivering a resultant control pressure signal via conduit 34 to the servo valve 16 for the additional biasing of the swash plate 17 via the servo valve 16. A pilot pump 36 is connected to the signal control means 26 for providing the pressurized control fluid stream 28. A relief valve 38 is positioned between the pilot pump 36 and the signal control means 26 in fluid communication with the fluid stream 28 for maintaining the fluid stream in a preselected pressure range. Check valves 92,93,94 are preferably provided for passing only the largest of the load pressure streams from elements 12,13,14 to control means 26 as a hydraulic load stream 30.

Figure 2:
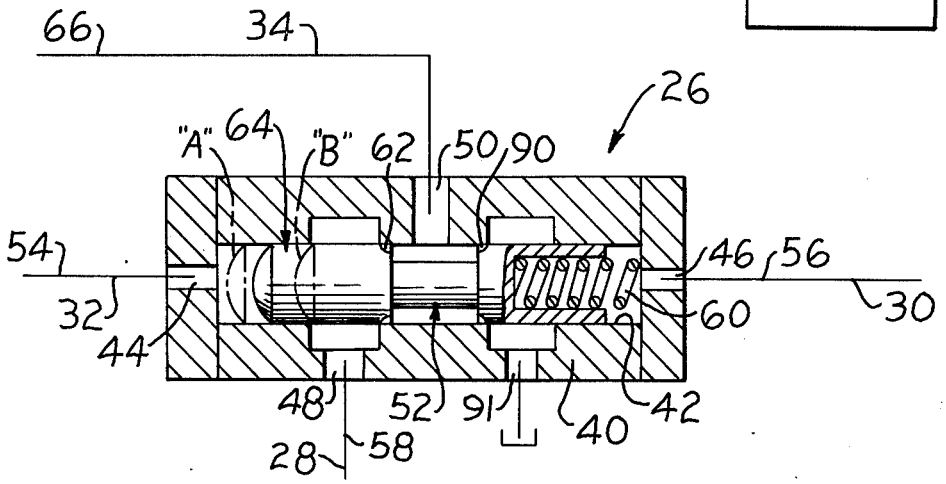
FIG. 2 is an enlarged diagrammatic sectional view of a control means of FIG. 1.

Referring to FIG. 2, the signal control means 26 has a housing 40 having a bore 42, and first, second, and third inlet ports 44,46,48, and an outlet port 50 opening into the housing bore 42.

A piston 52 of a general spool configuration is positioned within the bore 42. At preselected positions of the piston 52, relative to the housing 40 and the third inlet port 48 and the outlet port 52, a fluid pathway is formed therethrough. The piston 52 is movable in the bore 42 between a first position shown by broken lines "A" at which the fluid pathway between port 48 and port 50 is open and a second position, shown by broken lines "B" at which the fluid pathway between ports 48,50 is substantially closed and ports 50,91 are substantially open.

A first conduit means 54 communicates the first port 44 with fluid discharging from the piston pump 10 for biasing the piston 52 toward the second position. A second conduit means 56 communicates the second port 46 with hydraulic fluid of a work element 12,13, or 14 (FIG. 1) having a pressure working in opposition to fluid discharging from the pump 10 for biasing the piston 52 toward the first position. A third conduit means 58 communicates the third inlet port 48 with the control fluid stream 28.

A biasing means 60 is positioned in bore 42 for urging the piston 52 toward the first position.

Modulating slots 62 are positioned on a head portion 64 of the piston 52 adjacent the third inlet port 48 for improving control of the flow of fluid through the signal control means 26. Modulating slots 90 are provided for the same purpose.

By so constructing the control means 24 and associating it with the servo valve 16, the position of the swash plate 17 is further controlled by a pressure signal 66 imparted on the swash plate through the servo valve 16. As is known in the art, a biasing force subjected upon the servo valve and/or swash plate can be in either a first direction or an opposed second direction, and this invention is meant to cover biasing in either direction. As set forth above, that pressure signal 66 is delivered to the servo valve 16 via conduit 34 and said signal is provided by controllably modifying the pressure of fluid discharging from the piston pump 10 acting on the head end 64 of the piston 52 in opposition to the pressure of the hydraulic load stream 30 and biasing means 60 acting on the other end of the piston 52 and controllably regulating the magnitude of the fluid pathway through the signal control means 26.

Other aspects, objects, and advantages of this invention can be obtained from a study of the drawings, the disclosure, and the appended claims.

What is claimed is:

1. In a piston pump assembly having a housing, an angularly adjustable swash plate for controlling the volume of fluid discharging from the pump to work element, a servo valve having a biasing means and being positioned in contact with the swash plate at a location sufficient for biasing the swash plate toward one of a maximum or minimum fluid discharge position, and means positioned in contact with the swash plate at a location sufficient for biasing the swash plate toward the other fluid discharge position, said means being in communication with fluid discharging from the pump for biasing the swash plate in response to the pressure of the discharging fluid, the improvement comprising:

control means for imparting a resultant biasing force directly onto the servo valve of the swash plate for biasing the swash plate through the servo valve in response to the resultant biasing force, said resultant biasing force being a substantially constant pressure control fluid stream as modified by a load pressure acting in opposition to fluid discharging from the pump.

2. Apparatus, as set forth in claim 1, wherein the control means comprises:

signal control means for modifying the control fluid stream in response to a load pressure, a biasing means, and a pump discharge pressure and delivering a resultant control pressure signal; and means for passing the control pressure signal to the servo valve for the biasing of the servo valve.

3. Apparatus, as set forth in claim 2, including:

a pilot pump connected to the signal control means for providing the control fluid stream; and a relief valve positioned between the pilot pump and the signal control means and in fluid communication with the control fluid stream for maintaining said fluid stream within a preselected pressure range.

4. Apparatus, as set forth in claim 2, wherein the signal control means comprises:

a housing having a bore, first, second, and third inlet ports, and an outlet port;

a piston positioned within the bore and being of a construction for forming a fluid pathway between the third inlet port and the outlet port at preselected positions of the piston relative to the housing, said piston being movable between a first position at which the fluid pathway is open and a second position at which the fluid pathway is substantially closed;

first conduit means communicating the first port with fluid discharging from the piston pump for biasing the piston toward the second position with fluid discharging from the piston pump;

second conduit means communicating the second port with fluid of a work element having a pressure in opposition to fluid discharging from the pump for biasing the piston toward the first position with fluid from the work element;

third conduit means communicating the third port with the control fluid stream; and biasing means for urging the piston toward the first position.

5. Apparatus, as set forth in claim 4, including:

a pilot pump connected by the third conduit means to the third port of the housing; and a relief valve connected in fluid communication with the third conduit means for maintaining said control fluid stream within a preselected pressure range.

6. Apparatus, as set forth in claim 4, wherein the piston is of a spool configuration and has modulating slots in a portion of the piston adjacent the third port for controlling the flow of fluid through the signal control means.

* * * * *

Disclaimer 4,028,890.—*Cyril W. Habiger* and *Donald L. Hopkins*, Joliet, Ill. PISTON PUMP ASSEMBLY UTILIZING LOAD PRESSURE CONTROL. Patent dated June 14, 1977. Disclaimer filed Apr. 21, 1980, by the assignee, *Caterpillar Tractor Co.*

Hereby enters this disclaimer to all claims of said patent.

[*Official Gazette, June 17, 1980.*]